United States Patent [19]

Michael

[11] Patent Number: 5,062,562

[45] Date of Patent: Nov. 5, 1991

[54] PORTABLE POWER FASTENING TOOL

[75] Inventor: James V. Michael, Hayward, Calif.

[73] Assignee: Senco Products, Inc., Cincinnati, Ohio

[21] Appl. No.: 379,819

[22] Filed: Jul. 14, 1989

[51] Int. Cl.[5] ..... B25C 1/04

[52] U.S. Cl. ..... 227/111; 227/130; 227/151

[58] Field of Search ..... 227/8, 130, 153, 111, 227/66, 29, 151, 152, 30

[56] References Cited

U.S. PATENT DOCUMENTS

| | | | |
|---|---|---|---|
| 1,060,377 | 4/1913 | Stutzer | 227/111 |
| 1,671,660 | 5/1928 | Vilneau et al. | 227/111 |
| 1,693,290 | 11/1928 | Fawcett | 227/111 |
| 2,457,984 | 1/1949 | Dougherty | 227/111 |
| 3,040,327 | 6/1962 | Michel | 227/66 |
| 3,434,643 | 3/1969 | Wandel | 227/66 X |
| 3,796,365 | 3/1974 | Downing | 227/111 X |
| 4,666,074 | 5/1987 | MacDonald | 227/66 |
| 4,688,710 | 8/1987 | Massari, Jr. et al. | 227/130 X |

*Primary Examiner*—Frank T. Yost
*Assistant Examiner*—Rinaldi Rada
*Attorney, Agent, or Firm*—Jerrold J. Litzinger

[57] ABSTRACT

A portable power fastening tool for fastening flooring or the like using fastening members such as nails and staples also includes a driver member for the fasteners and a hammer member, both of which are propelled by an air motor to simultaneously compressively strike the flooring during the fastening operation, thereby to compress the flooring and eliminate gaps or voids. Preferably, the tool is mounted on a wheeled carriage which facilitates movement from one fastening location to another.

10 Claims, 5 Drawing Sheets

FIG. 1
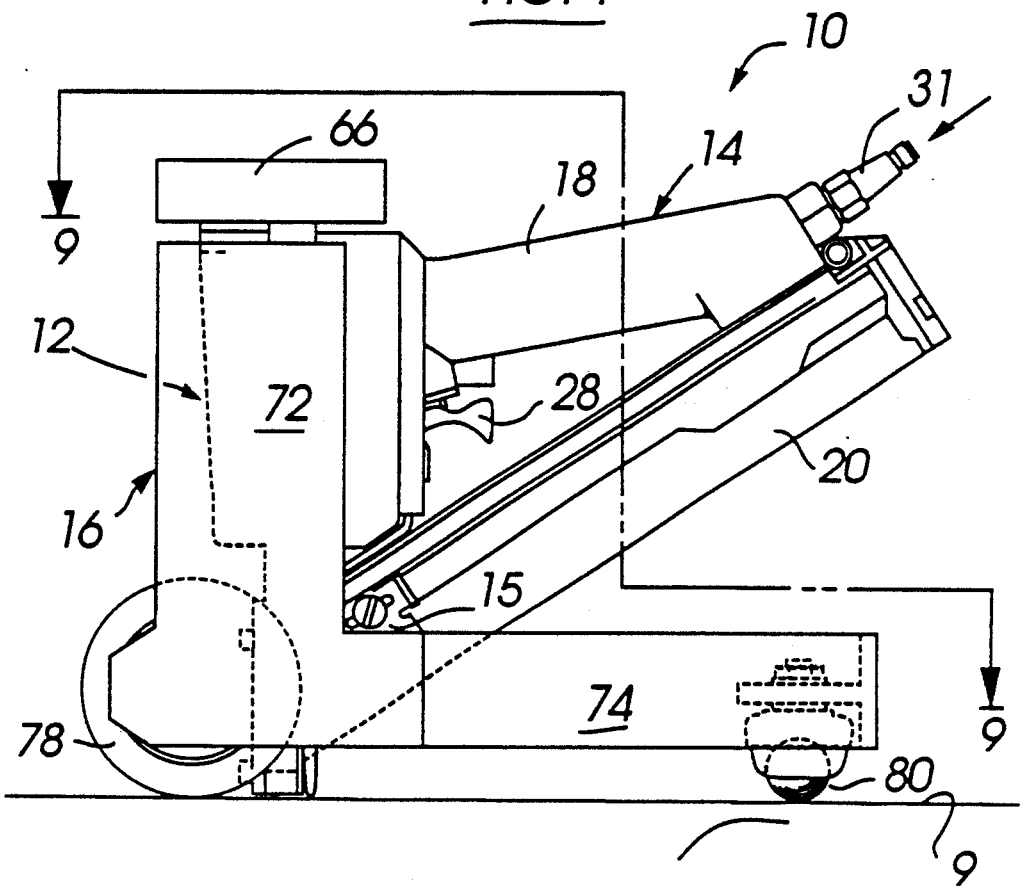
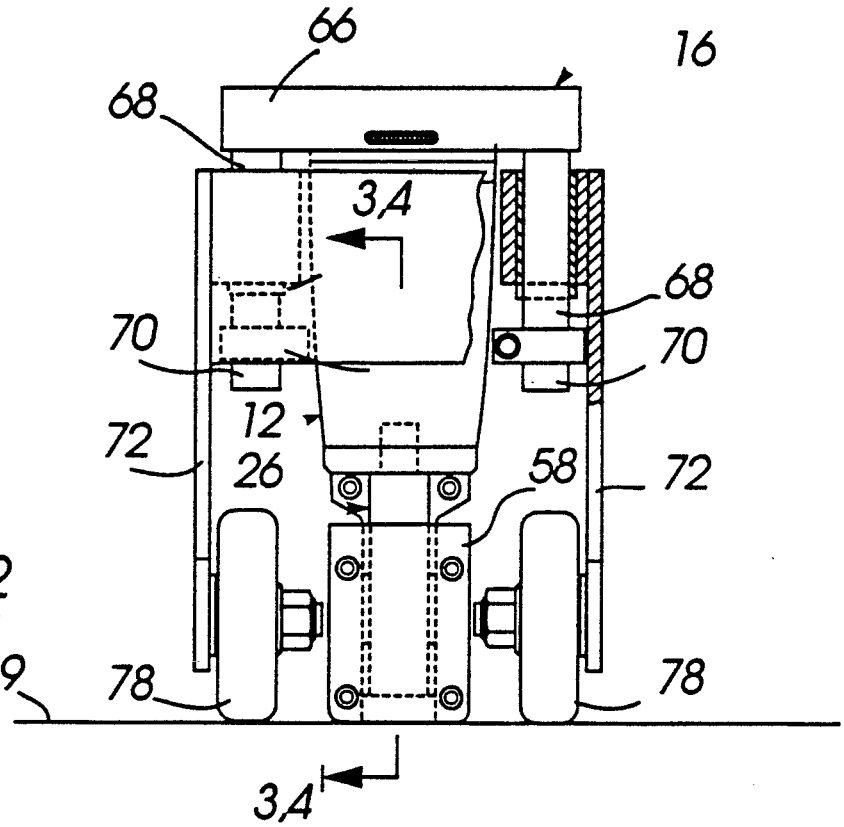
FIG. 2

FIG. 9
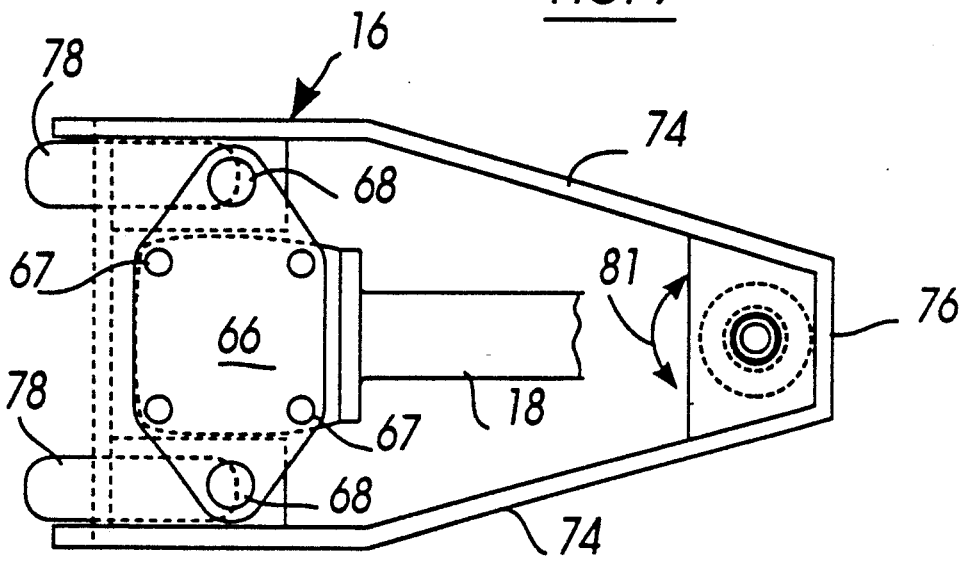
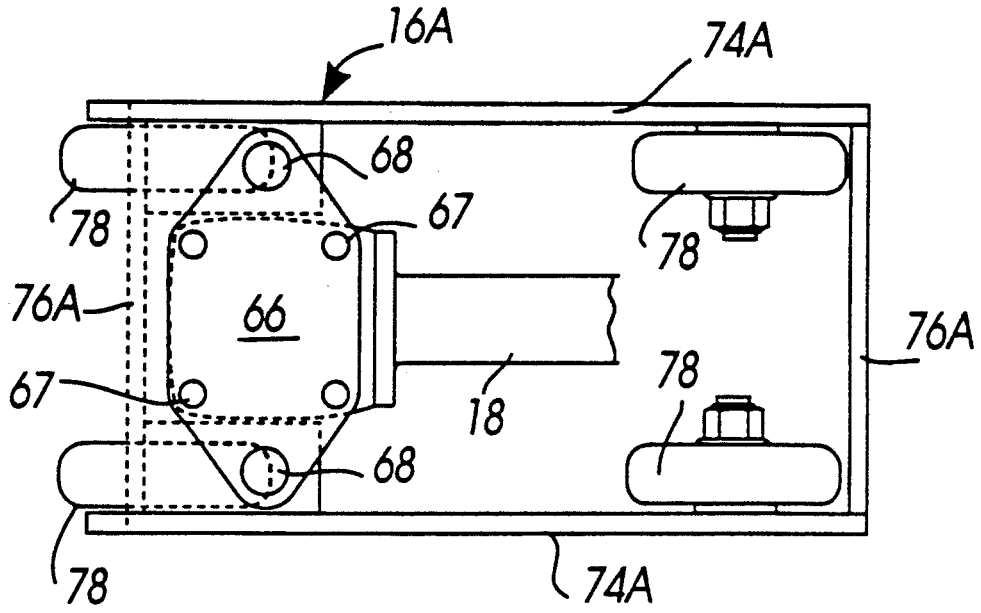
FIG. 10

PORTABLE POWER FASTENING TOOL

BACKGROUND OF THE INVENTION

1. Field of the Invention

The present invention relates to power fastening tools and, in particular, to portable power tools for nailing and/or stapling flooring and the like.

2. Description of the Related Art

Commonly assigned U.S. Pat. No. 4,688,710, issued Aug. 25, 1987, to Massari et al, describes a relatively lightweight, hand-held modular power fastening tool which uses interchangeable nail and staple magazine units. One commercially available version of this modular power fastening tool is the SFNI Finish Nailer, manufactured by the common assignee, Senco Products, Inc., Cincinnati, Ohio 45244, which is useful for fastening furniture, display cases, window and door casings, and floors and in various other similar fastening operations.

The Massari et al tool is operated similarly to other state-of-the art nailers and, thus, despite its several advantages, which include but are not limited to modularity and interchangeability, does not rectify two distinct disadvantages of conventional tools. That is, to fasten flooring, conventional fastening tools must be lifted and carried by hand from one fastening location to another. Also, flooring frequently has spaces or gaps, such as that identified by numeral 7 in FIG. 3, between the old or sub-floor 8 and the new floor or floor covering 9. To compress the components 8 and 9 and thereby eliminate the spacing 7 and permit stable, squeak-free joinder of the components 8 and 9, it is necessary to strike the floor covering 9 just prior to driving the fastener into the floor or while the fastener is being driven. Typically, this compressive blow is struck manually using a hammer or commercially available power device. As will be appreciated, the repetitive process of lifting the tool and striking the floor can be tiring, especially during long periods of operation.

SUMMARY OF THE INVENTION

1. Objects

It is a primary object of the present invention to provide an improved fastening tool which itself compressively impacts the flooring (or other) components which are to be fastened in controlled fashion to facilitate joinder of the components without gaps therebetween.

It is also an object of the present invention to provide an improved fastening tool which incorporates a carriage for moving the tool along the floor from one fastening location to another.

2. Summary

The above and other objects are accomplished in my fastening tool, which is an improvement of the tool described in the above-mentioned Massari et al U.S. Pat. No. 4,688,710. The Massari '710 patent is incorporated by reference in its entirety for its detailed description of an exemplary fastening tool to which my improvements apply.

Specifically, in one aspect, my invention is embodied in a pneumatic tool for selectively driving fasteners such as staples and nails into a surface of a floor or the like and compressively striking the surface, which comprises: a barrel means having a bore which captures an elongated driver member and an elongated hammer member for independent side-by-side sliding movement along the length of the bore in a first driving direction and a second, opposite, retraction direction; an air motor mounted to the barrel means and including a reciprocal piston means which is operatively connected to the driver member for moving the driver member in the first and second directions and is adapted for moving the hammer member in the first, driving direction; and a magazine means serially supplying fasteners via a slot in the barrel into the path of movement of the driver member, whereby driving movement of the piston impels the hammer member to strike the surface and the driver member to drive a fastener into the surface.

In another and preferred aspect, the barrel includes first and second longitudinally-extending side-by-side grooves. The first groove captures the driver member and the second groove captures the hammer member in sliding contact with the driver member. Preferably, one of the hammer member and the driver member has a longitudinal groove therein which slidably captures the other member.

In still other presently preferred aspects, my pneumatic tool incorporates a carriage mounted thereto for moving the tool from one fastening location to another, which carriage includes a frame surrounding the lower periphery of the tool and wheels or casters or the like mounted to the frame. In addition, one or a plurality of vertical shafts can be mounted to the tool, aligned generally parallel to the path of movement of the driver member and the hammer member. A pair of uprights are mounted at lower ends thereof to the frame means and are slidably mounted on the shaft(s) for sliding movement thereon between first and second positions to facilitate recoil absorption during operation.

BRIEF DESCRIPTION OF THE DRAWINGS

The above and other aspects of the present invention are described below in detail with respect to the drawings, in which:

FIG. 1 is a side elevation view of a power fastening tool which embodies my invention;

FIG. 2 is a front elevation view of the power fastening tool of FIG. 1;

FIG. 9 is a simplified top plan view, partially cutaway, taken along the line 9—9 of FIG. 1, further illustrating the three-point wheeled carriage incorporated in the tool of FIG. 1; and FIG. 10 is a simplified top plan view, partially cutaway, of a four-wheeled version of the carriage.

DETAILED DESCRIPTION OF THE PREFERRED EMBODIMENT(S)

1. Overall Construction and Operation

Figure 4:
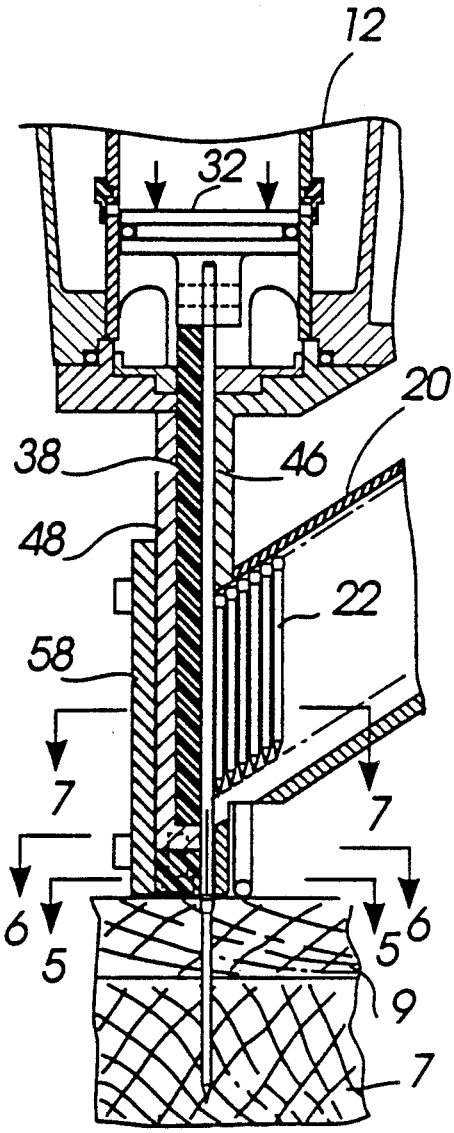
FIGS. 3 and 4 are vertical cross-sectional views taken along the lines 3—3, 4—4 in FIG. 2 illustrating the compressive impact (hammering) and nailing operations of the tool of FIG. 1.

Referring initially to FIGS. 1 and 2, there is depicted my power fastening tool 10 that is an improvement of the tool described in Massari et al U.S. Pat. No. 4,88,710, which patent is hereby incorporated by reference in its entirety. The tool 10 includes an air motor housing 12, which mounts an air motor (not shown) therein, and a removable handle and magazine assembly 14 which is attached to the tool as by screw(s) 15. Motor housing 12 and handle/magazine assembly 14 are mounted to a wheeled carriage 16 which permits the tool 10 to be rolled from one fastening location to another.

The illustrated assembly 14 comprises a handle 18 and a nail magazine 20. A second, staple assembly (not shown) can be used which is interchangeable with the nail assembly 14.

Figure 3:
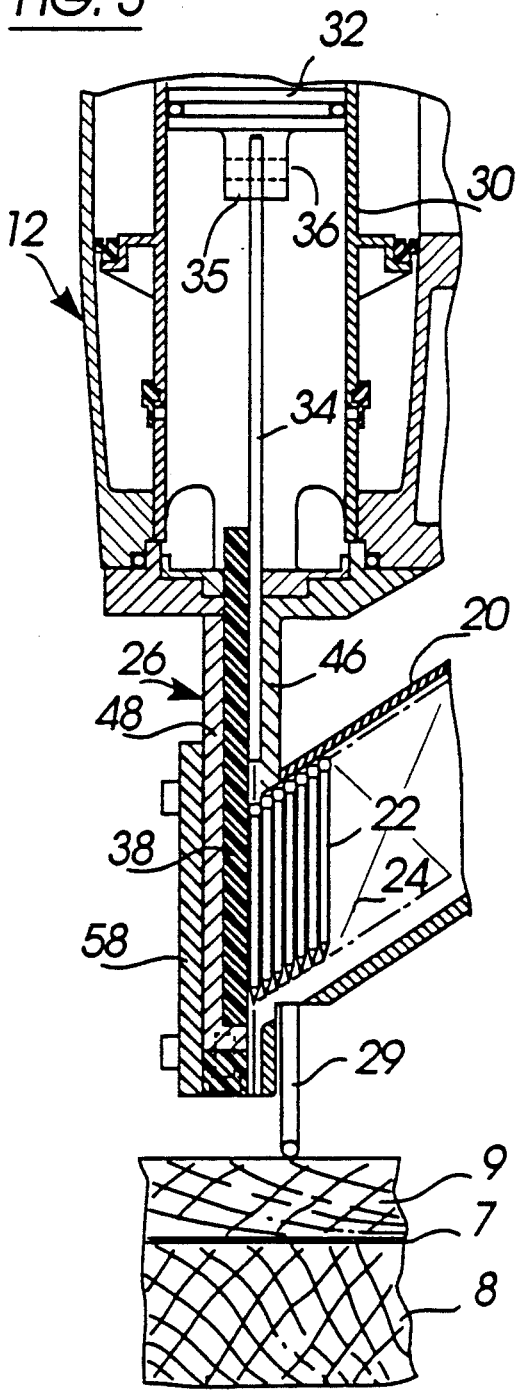
Figure 7:
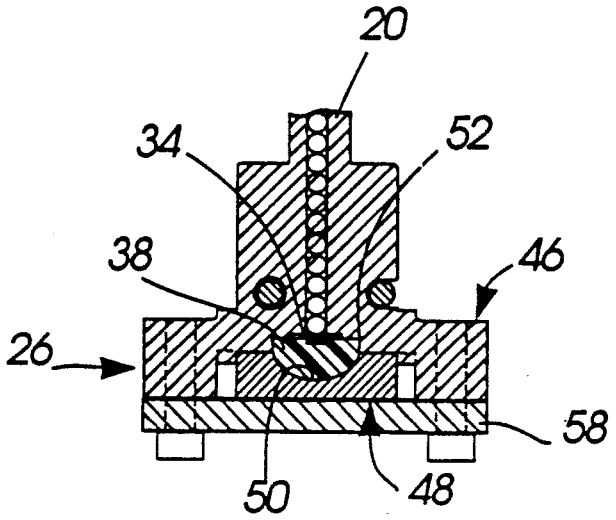
FIGS. 5, 6 and 7 are horizontal cross-sectional views taken along lines 5—5, 6—6 and 7—7, respectively, in FIG. 4 through different vertical positions of the tool barrel.
Figure 6:
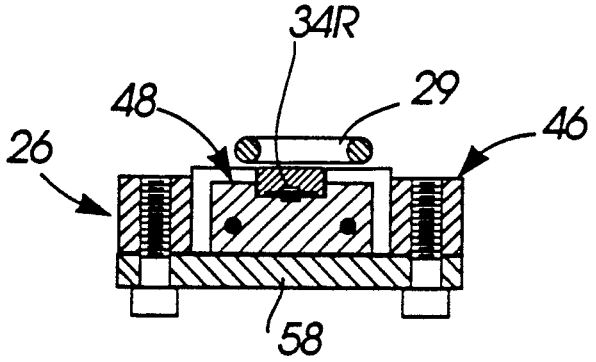
Figure 5:
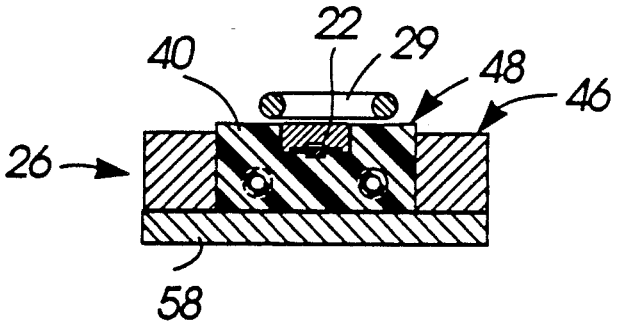

Referring next to FIGS. 3 and 4, the magazine 20 is adapted for holding therein a multiplicity of nails 22-22, which are biased by spring 24 toward barrel assembly 26. By gripping the handle 18 and moving the tool 10 downwardly against the floor, safety 29 (the operation of which is described in the referenced Massari et al '710 patent), is depressed within the tool and operates a switch (not shown), for opening a vent in the lower portion of cylinder 30 and permitting downward movement of the piston 32. Thus, with the tool 10 engaging the floor surface 9, depressing trigger 28, FIG. 1, causes air under pressure from an air compressor (not shown) to enter the upper section of the cylinder 30 via fitting 31, thereby driving the O-ring-sealed piston 32 downwardly.

An elongated driver means 34 is mounted by pin 36 to the protruding piston member 35 and is of selected length relative to the length of the hammer member 38 and to the length of the nails 22 such that the driver means engages the nail 22 in the barrel during the downward or driving stroke of piston 32 and drives the nail 22 from the barrel entry position shown in FIG. 3 into the floor 9/8. Also, protrusion 35 on the bottom side of the piston 32 engages a plunger or hammer member 38 which is slidably captured within the barrel assembly 26 and drives the bottom end 40 of the hammer against the floor, flattening the floor covering 9 against the sub-floor or old floor 8, as shown in FIG. 4, and holding the components 8 and 9 together substantially devoid of any air gap 7 during completion of the nailing operation. In short, the hammer member 38 compressively impacts the floor, as indicated in FIG. 4, flattening the covering 9 against the sub-floor 8 at the end of the fastening stroke so that the nail 22 fastens the covering 9 to the floor free of gaps.

After a fastening location at one location, the carriage 16 is used to roll the tool 10 along the floor to the next location, preparatory to the next driving and nailing step.

2. Hammer and Nail Driver

Figure 8:
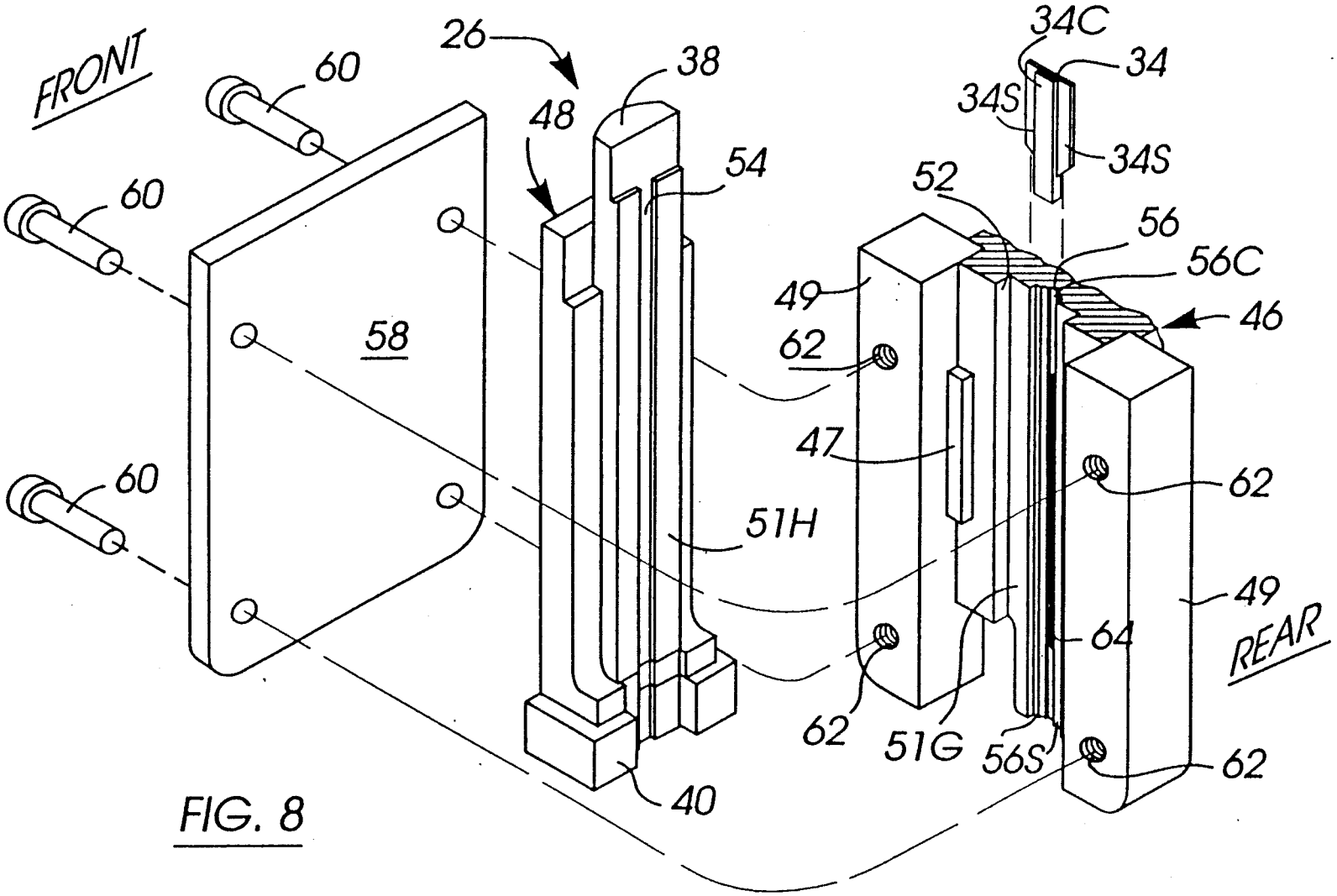
FIG. 8 is an exploded perspective view of the barrel.

Referring to FIGS. 5–8 and, in particular, to FIG. 8, barrel guide assembly 26 comprises an elongated, shallow, U-shaped rear guide member 46 and mating elongated, front guide member 48 which fits within the side members 49-49 of the U-shaped rear guide member and is centered therein by members 47-47. A plate or door 58 is clamped over the front guide member 48 and is mounted to the side members 49-49 of the rear guide member 46 as by screws 60-60 which are received into threaded holes 62-62 in barrel guide assembly 46.

A hammer or plunger guide groove means comprising groove 50 (FIG. 7) is formed in the inside face of the front guide member 48; a cooperating groove 52 is formed in the inside face of the rear guide member 46 for cooperatively and slidably receiving the hammer or plunger member 38 such that the hammer member surfaces such as 51H slide along mating groove surfaces such as 51G. Also, a driver guide groove 54 is formed in the inside face of the hammer member 38 and in combination with stepped hammer guide groove 56, which comprises a deep center section 56C and shallow flanking side sections 56S in the bottom face of groove 52, slidably receives the driver member 34. Driver member 34 has a generally flat rear surface 34R (see, e.g., FIG. 6) and enlarged center section 34C on the front or inner side thereof which is slidably captured within the groove 54, as well as reduced thickness side members or wings 34S which are slidably captured within groove sections 56S.

As a result of the described construction, the hammer member 38 and the driver member 34 capture and align one another, yet permit independent sliding movement, including oppositely- directed movement, of one member relative to the other. This permits the driver member 34, which is attached to piston 32, to be retracted and advanced by the piston 32 during its upward and downward strokes, thereby allowing the serial entry of nails into the barrel during the upward or retraction stroke and driving the nails into the flooring during the downward stroke, while the unattached, free-floating hammer is moved by the piston 32 only during the downward, driving stroke. In addition, the enlarged dimension of center groove section 56C transverse to the width thereof permits nails 22 to traverse slot 64, FIG. 8, in the rear guide member 46 into the barrel groove section 56C and to freely slide along that groove section 56C under the driving impetus of the piston 32.

3. Carriage Assembly

Referring now to FIGS. 1 and 2, in conjunction with FIGS. 9 and 10, the carriage assembly 16 comprises a bracket plate 66 which is mounted to the top of the motor housing 12, as by screws 67-67 and has mounted thereto a plurality of vertical stub or support shafts 68-68 having adjustable stops 70-70 mounted thereon. Carriage frame assembly includes upright members 72-72 and lower, horizontal frame-defining side and end members 74-74 and 76. Upright members 72-72 are slidably mounted on the shafts 68-68 between the bracket 66 and stops 70-70 to provide adjustable positioning of the tool relative to the elevation of the flooring and to absorb recoil during the hammering and nailing operation. Two wheel means 78-78 are mounted to the lower frame assembly on the opposite front sides thereof and a third wheel means 80, illustratively, a caster, is mounted between the rear ends of the generally converging sides 74-74.

An alternative carriage 16A, shown in FIG. 10, includes a generally rectangular lower frame comprising two sides 74A-74A, each having two wheel means 78-78 mounted proximate the opposite ends 76A thereof. The four-wheeled carriage 16A possibly provides somewhat greater stability than the three-wheeled carriage 16. However, the three-wheeled carriage is of lighter weight and is more maneuverable due to the use of the rotating ball caster 80, rotation of which is indicated schematically by arrow 81, FIG. 9.

Based upon the above description of the theory, structure and operation of my improved fastening tool, those of usual skill in the art will readily derive additional embodiments and modifications thereof which are within the scope of the invention and of the following claims, which define that invention.

Having thus described preferred and alternative embodiments, what is claimed is:

1. A pneumatic tool for selectively driving fasteners into a surface of a floor and compressively striking the surface, comprising:

a barrel assembly located at an end of the tool having a bore therein comprising a longitudinal first groove slidably capturing a driver member and a longitudinal second groove capturing a hammer member in sliding contact with the driver member, one of hammer member and the driver member having a third longitudinal groove therein for slidably capturing the other member, thereby allowing independent sliding movement of the members along the bore in a first driving direction toward one end of the bore and a second, opposite, retraction direction;

an air motor mounted to the barrel assembly and including a reciprocable piston means operatively connected to the drive member for moving the drive member in the first and second directions;

the piston means being adopted for pushing the hammer member in the first, driving direction;

a fastener magazine secured to the barrel assembly and adopted for serially supplying fasteners via a slot in the barrel assembly into the barrel assembly to a position coincident with the path of the driver member, whereby driving movement of the piston means impels the driver member to drive a fastener through the one end of the bore and the hammer member to compressively strike the surface of the floor through said one end of the bore; and the tool further comprising a carriage mounted thereto which includes a frame for supporting the tool and wheel means mounted thereon for moving the carriage along the floor from one fastening location to another.

2. The pneumatic tool of claim 1, wherein the hammer member includes said third longitudinal groove therein slidably capturing the driver member.

3. The pneumatic tool of claim 1, further comprising a plurality of vertical supports mounted to a plate connected to the tool generally parallel to the path of the driver member and the hammer member, and a pair of upright members mounting the frame to the lower ends of the supports and slidably mounted on the supports for sliding movement thereon between a first position and a second position to facilitate recoil absorption during operation of the tool.

4. A pneumatic tool for selectively driving fasteners into a surface of a floor and compressively striking the surface, comprising:

a barrel assembly located at an end of the tool having a bore therein which slidably captures an elongated driver member and an elongated hammer member for independent sliding movement along the length of the bore in a first driving direction and a second, opposite, retraction direction;

an air motor mounted to the barrel assembly and including a reciprocable piston means operatively connected to the drive member for moving the drive member in the first and second directions;

the piston means being adapted for pushing the hammer member in the first, driving direction; and means serially supplying fasteners via a slot in the barrel assembly into the path of the driver member, whereby driving movement of the piston means impels the hammer member to strike the surface and the driver member to drive a fastener into the surface, with the barrel assembly having a first groove therein slidably capturing the driver member and a second groove therein capturing the hammer member in sliding contact with the driver member and in the path of the piston means, one of the hammer member and the driver member having a third longitudinal groove therein for slidably capturing the other member.

5. The pneumatic tool of claim 4, wherein the hammer member including said third longitudinal groove therein slidably capturing the driver member.

6. The pneumatic tool of claim 4, further comprising a carriage mounted thereto for moving the tool from one fastening location to another, said carriage including a frame upon which the tool is mounted and having wheel means mounted thereto for moving the carriage.

7. The pneumatic tool of claim 6, further comprising a plurality of vertical supports mounted to a plate connected to the tool generally parallel to the path of the driver member and the hammer member and a pair of upright members mounted at lower ends of the supports to the frame and slidably mounted on the supports for sliding movement thereon between a first position and a second position to facilitate recoil absorption during operation of the tool.

8. The pneumatic tool of claim 6, further comprising a handle mounted to the housing.

9. A pneumatic tool for selectively driving fasteners into a surface of a floor while compressively striking the surface, comprising:

air motor means including a piston reversibly movable along a cylinder;

a fastener driver member operatively connected to the piston for driving fasteners;

a housing for the motor means having an open end allowing the fastener driver member to extend therethrough;

a handle secured to the housing;

a barrel assembly having one end communicating with the open end of the housing and having an axis coincident with the path of the drive member and having an opposite, open end; the barrel assembly further including an internal bore extending generally coincident with the path of the driver member, and said assembly having a first groove therein slidably capturing the driver member and a second groove therein slidably capturing an elongated hammer member in sliding contact with the driver member and in the path of the piston;

the piston being operatively connected to the driver member and movable in driving and retracting strokes along the cylinder to move the driver member and the hammer member during said driving stroke; and a fastener magazine secured to the housing and adapted for serially supplying fasteners into the barrel assembly to a position coincident with the path of the driver member, whereby the fasteners are serially driven through the open end of said housing by the driver member and the hammer member is simultaneously driven through the open end of said housing to compressively strike the receiving surface.

10. The pneumatic tool of claim 9, wherein the hammer member includes a third longitudinal groove therein slidably capturing the driver member.

* * * * *